US007418893B2

(12) United States Patent
Hu

(10) Patent No.: US 7,418,893 B2
(45) Date of Patent: Sep. 2, 2008

(54) WRENCH WITH PRESSED CHARACTER UNITS

(76) Inventor: Bobby Hu, 8F, No.536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/610,019

(22) Filed: Dec. 13, 2006

(65) Prior Publication Data

US 2008/0047400 A1 Feb. 28, 2008

(30) Foreign Application Priority Data

Aug. 22, 2006 (TW) ..... 95214868 U

(51) Int. Cl.
*B25G 1/00* (2006.01)
*B25B 13/02* (2006.01)

(52) U.S. Cl. ..... 81/177.1; 81/119; 81/DIG. 5; 8/28

(58) Field of Classification Search ..... 81/119, 81/DIG. 5, 177.1, 125.1; D8/21–28
See application file for complete search history.

(56) References Cited

U.S. PATENT DOCUMENTS 5,079,978 A * 1/1992 Kupfer ..... 81/119
D334,122 S * 3/1993 Bang ..... D8/21
D352,215 S * 11/1994 Starck ..... D8/22
5,421,224 A * 6/1995 Bond ..... 81/DIG. 5
D445,656 S * 7/2001 Ranieri et al. ..... D8/22
6,907,803 B2 * 6/2005 Tuan-Mu ..... D8/25
6,912,937 B2 * 7/2005 Tuanmu ..... 81/119
D520,310 S * 5/2006 Hsien ..... D8/27
2007/0261520 A1 * 11/2007 Chang et al. ..... 81/177.1

OTHER PUBLICATIONS

Taiwanese Patent Appln. No. 530724, May 1, 2003, 4 pages, no English translation.
Taiwanese Patent No. M294392, Jul. 21, 2006, 18 pages, no English translation.

* cited by examiner

*Primary Examiner*—Hadi Shakeri
(74) *Attorney, Agent, or Firm*—Alan Kamrath; Kamrath & Associates PA

(57) ABSTRACT

A wrench includes a body having two ends and a handle between the ends of the body. At least one of the ends of the body can be used for driving an object. A plurality of character units are provided on each holding face and form an anti-slipping section. At least one of the holding faces includes at least one indication area located in the anti-slipping section. The indication area includes an indication marking.

24 Claims, 9 Drawing Sheets

WRENCH WITH PRESSED CHARACTER UNITS

BACKGROUND OF THE INVENTION

1. Field of the Invention

The present invention relates to a wrench with character units that form an anti-slipping section.

2. Description of the Related Art

Typical wrenches include a smooth handle with anti-rusting treatment. However, these wrenches cannot provide an anti-slipping effect at the handles. Taiwan Utility Model Publication No. 530724 discloses a wrench having a handle with an indentation section with embossed or debossed characters. However, no anti-slipping effect is provided, for the characters are located in a central area of the handle. As a result, the user's hand is liable to slip while using the wrench, as it is not uncommon that the user's hand has oil and dust.

Taiwan Utility Model No. M294392 discloses wrenches including handles with various pressed patterns. The pressed pattern of each handle is located around a trademark on the handle. However, the pressed pattern providing a background of the trademark is too complicated and, thus, obscures the trademark, failing to obtain the desired advertising effect.

SUMMARY OF THE INVENTION

A wrench in accordance with the present invention includes a body having two ends and a handle between the ends of the body. At least one of the ends of the body is adapted for driving an object. A plurality of character units are provided on each holding face and form an anti-slipping section. At least one of the holding faces includes at least one indication area located in the anti-slipping section. The indication area includes an indication marking. The character units provide a prominent characterizing effect in addition to anti-slipping effect.

The character units may be embossed or debossed.

The character units may be regularly arranged to provide an anti-slipping effect in a desired direction or irregularly arranged to provide an anti-slipping effect in all directions.

Preferably, each character unit includes a trademark, figures, characters, marks, symbols, a trade name, or a combination thereof.

Preferably, the indication marking includes a size of the wrench, a trademark, figures, characters, marks, symbols, a trade name, or a combination thereof.

Preferably, the indication marking is the same as but larger than each character unit.

Preferably, the indication marking has a length two to four times of that of each character unit and a width two to four times of that of each character unit, providing the required prominent characterizing effect.

In an example, the at least one indication area is surrounded by the character units.

In another example, the indication marking is spaced from the character units.

In a further example, the character units extend into the at least one indication area and overlap with the indication marking.

In still another example, at least some of the character units overlap with each other.

Preferably, the holding faces of the wrench respectively correspond to upper and lower horizontal faces of the ends of the wrench and the lateral faces of the wrench correspond to outer circumferential faces of the ends of the wrench.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
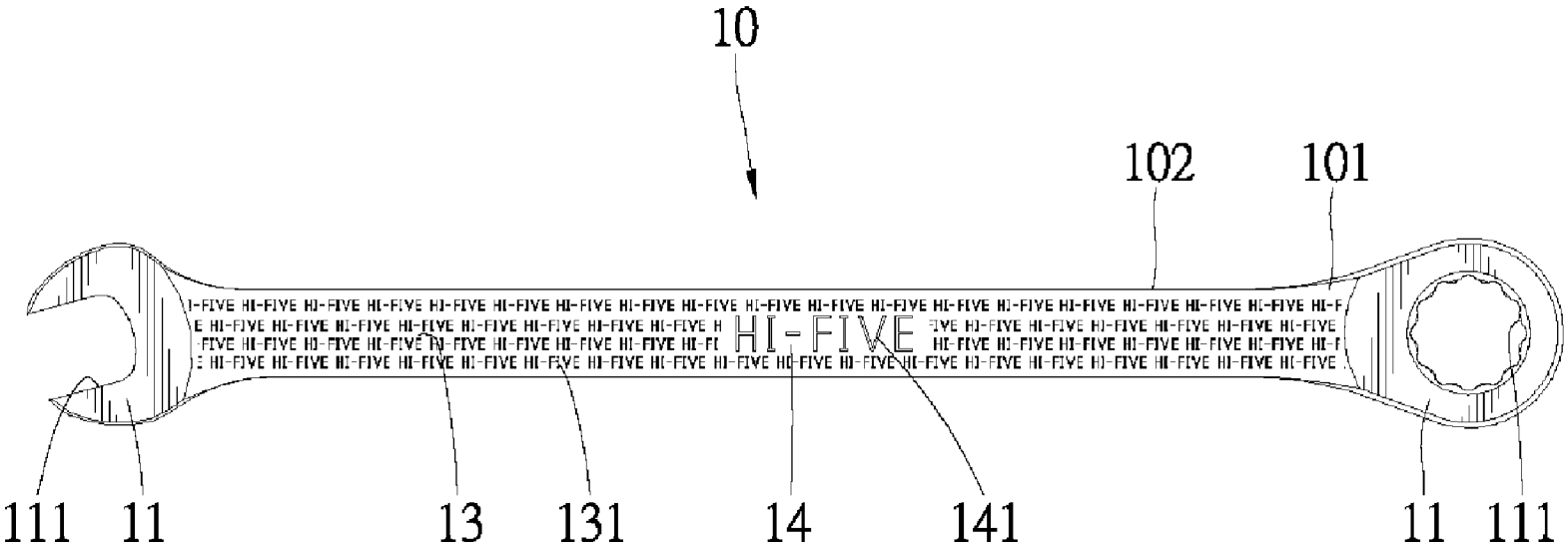
FIG. 1 is a top view of an example of a wrench in accordance with the present invention.

Referring to FIG. 1, an example of a wrench in accordance with the present invention comprises a handle 10 having two ends 11. Each end 11 of the handle 10 includes a driving section or driving member 111 for driving a fastener, a socket, an adaptor, etc. In the example shown in FIG. 1, the handle 10 includes an open end and a box end. In another example shown in FIG. 2, the handle 10 includes two open ends. In a further example shown in FIG. 3, the handle 10 includes two box ends.

The handle 10 includes two opposite holding faces 101 and two opposite lateral faces 102 extending between the holding faces 101. Each holding face 101 has a width greater than that of each lateral face 102. In this example, the holding faces 101 respectively correspond to upper and lower horizontal faces of the ends 11 of the wrench whereas the lateral faces 102 correspond to outer circumferential faces of the ends 11 of the wrench.

A plurality of character units 131 are provided on each holding face 101 and form an anti-slipping section 13 for providing the handle 10 with friction. The character units 131 may be embossed or debossed to provide the required anti-slipping effect. Further, the character units 131 may be arranged in a matrix. Alternatively, the character units 131 may be aligned crosswise or slantwise to provide desired anti-slipping effect in desired directions.

Each character unit 131 may be meaningful words such as English characters or a trademark. Alternatively, each character unit 131 may include figures, characters, marks, symbols, trade name, or combination thereof. The character units 131 provide a prominent characterizing effect in addition to the anti-slipping function. The customers will be impressed and the desire of purchase will rise in the customers' minds.

Each holding face 101 of the handle 10 may further include an indication area 14 in the anti-slipping section 13. In this example, the indication area 14 is surrounded by the anti-slipping section 13. The indication area 14 may include an indication marking 141 that shows the size of the wrench, trademarks, trade names, figures, or a combination thereof.

Alternatively, the indication area 14 is an indentation into which a board (not shown) is fixed, with the board bearing the size of the wrench, a trademark, a trade name, figures, characters, marks, symbols, or a combination thereof.

Figure 2:
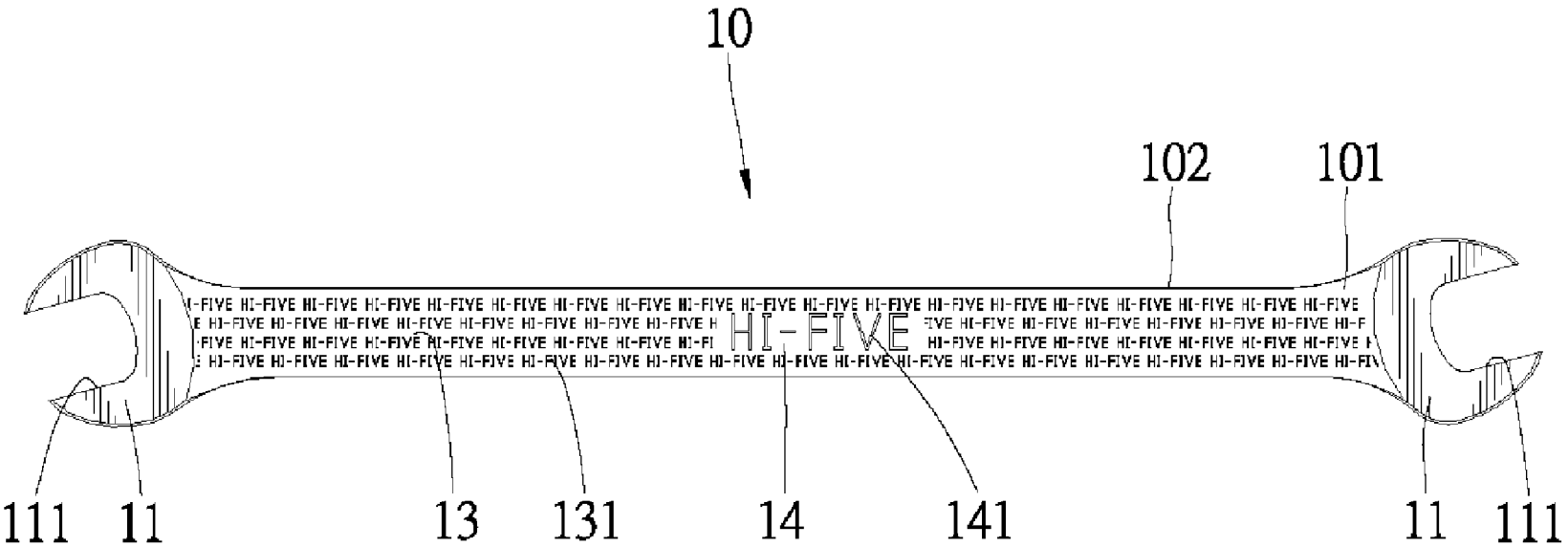
FIG. 2 is a top view illustrating another example of the wrench in accordance with the present invention.
Figure 3:
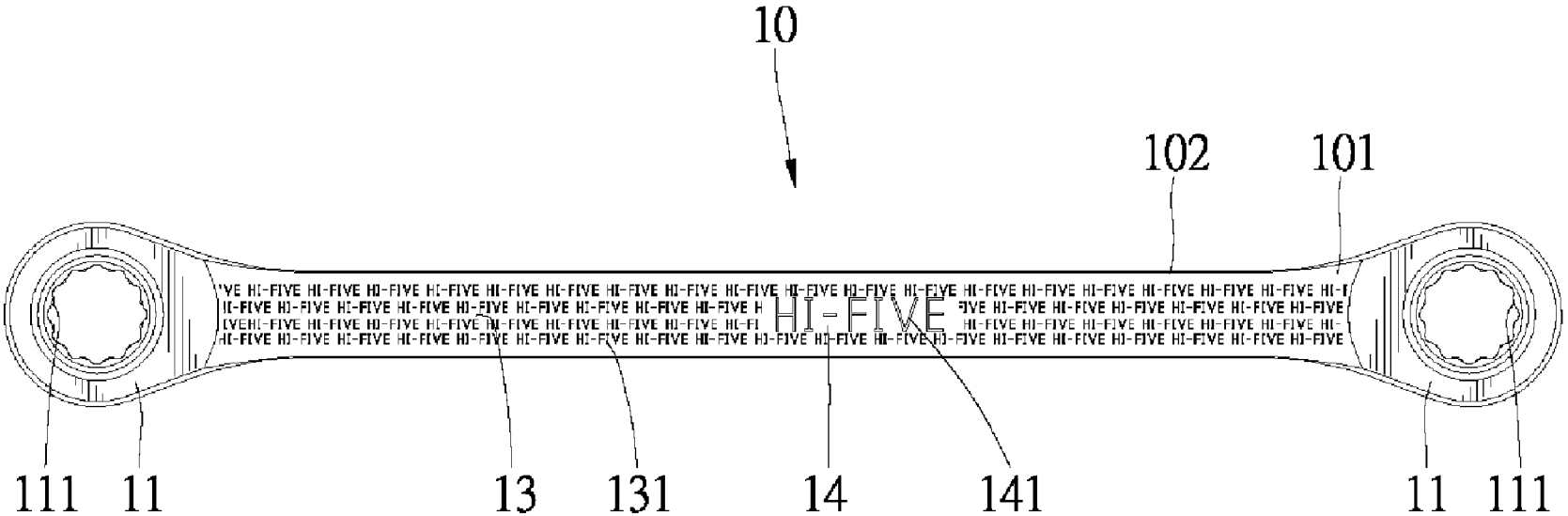
FIG. 3 is a top view illustrating a further example of the wrench in accordance with the present invention.

In the examples shown in FIGS. 1 through 3, the character units 131 are trademarks, and the indication marking 141 of the indication area 14 is a trademark identical to the character units 131. Further, four sides of the indication marking 141 in the indication area 14 are spaced from the character units 131.

Figure 4:
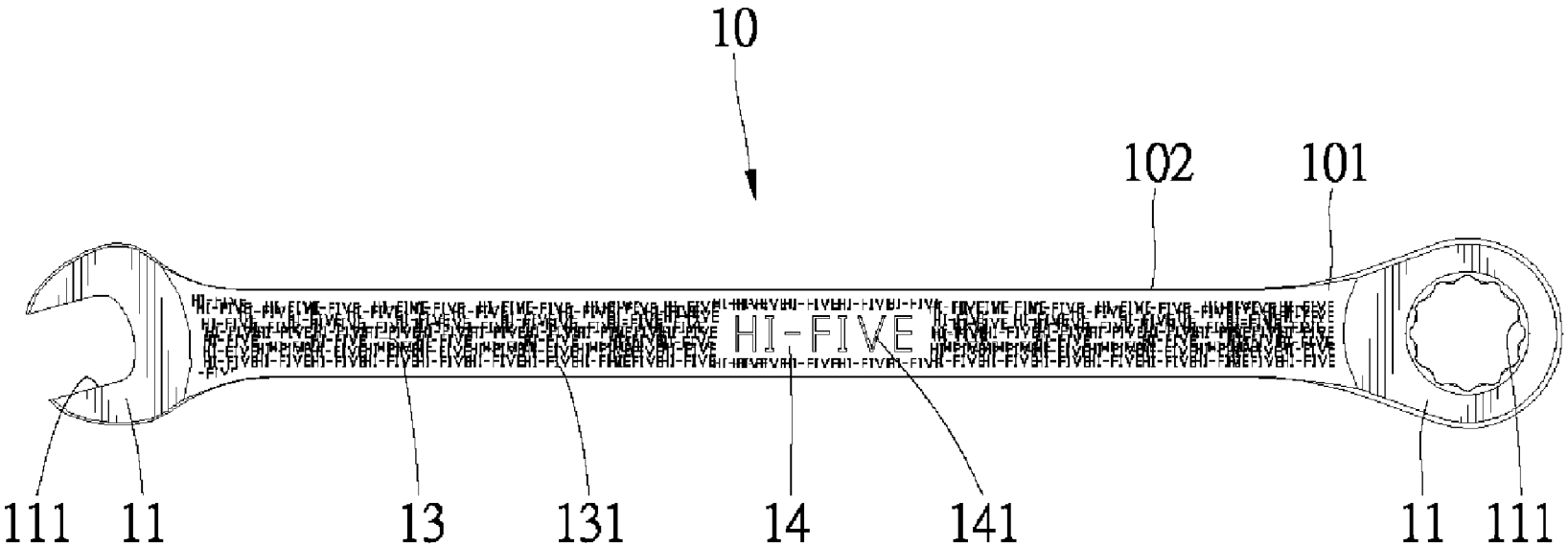
FIG. 4 is a top view illustrating still another example of the wrench in accordance with the present invention.

In the example shown in FIG. 4, some or all of the character units 131 overlap with each other to provide directionless anti-slipping effect.

Figure 5:
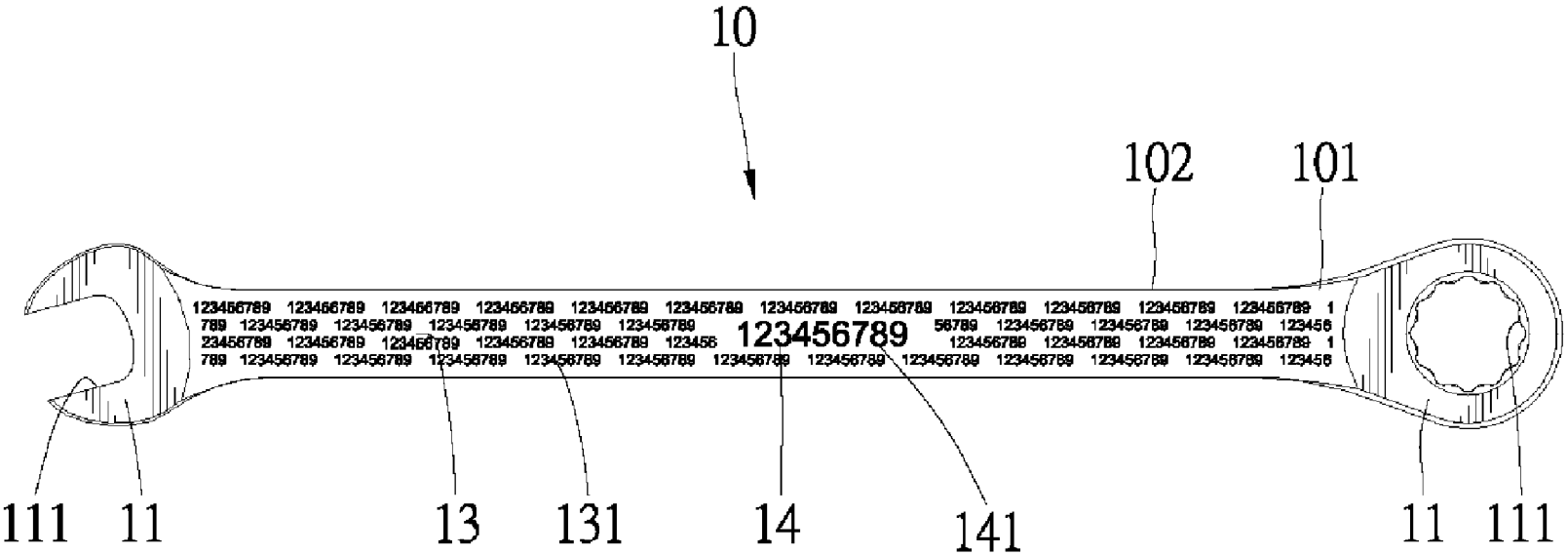
FIG. 5 is a top view illustrating yet another example of the wrench in accordance with the present invention.

In the example shown in FIG. 5, the character units 131 are figures, and the indication marking 141 of the indication area 14 includes figures identical to the character units 131.

Figure 6:
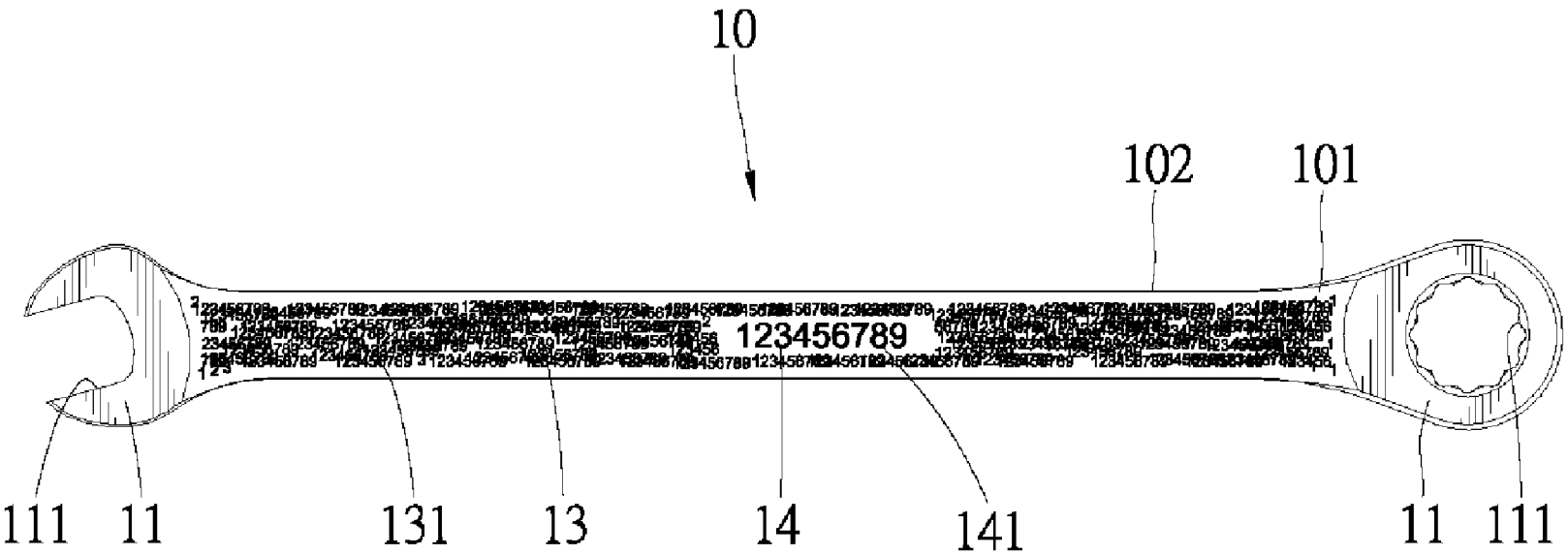
FIG. 6 is a top view illustrating still another example of the wrench in accordance with the present invention.

In the example shown in FIG. 6, which is modified from the example of FIG. 5, some or all of the character units 131 overlap with each other to provide directionless anti-slipping effect.

Figure 7:
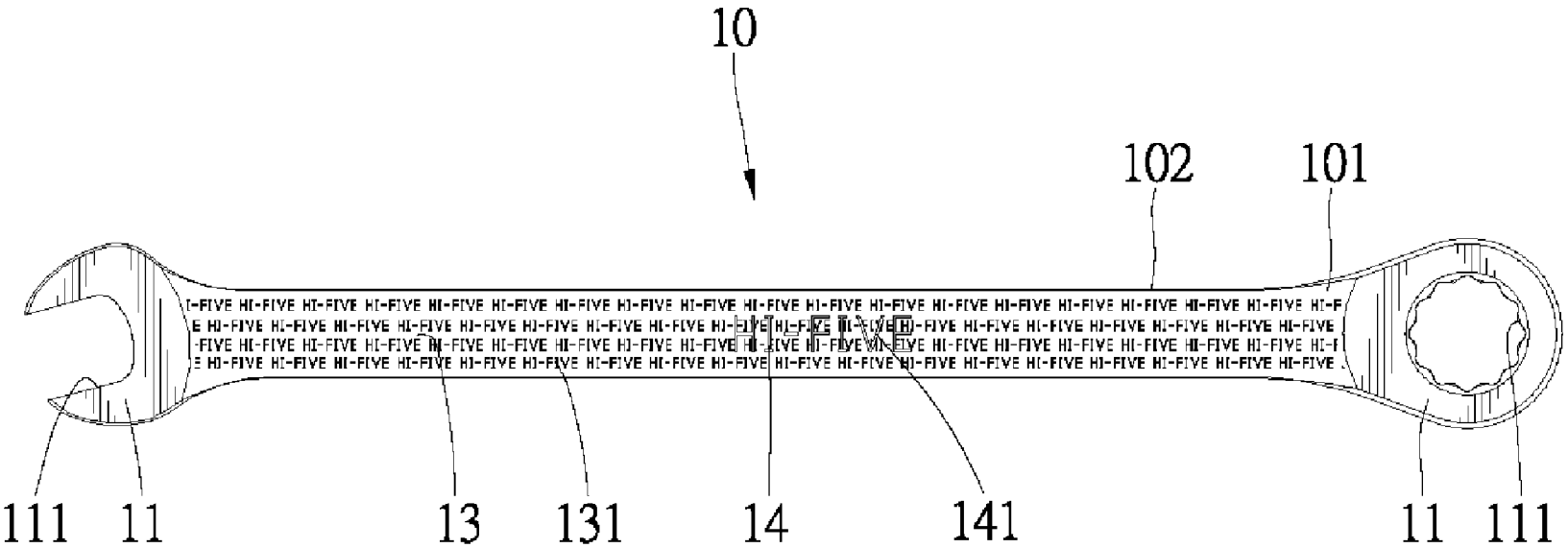
FIG. 7 is a top view illustrating yet another example of the wrench in accordance with the present invention.

In the example shown in FIG. 7, the character units 131 that form the anti-slipping section 13 extend into the indication area 14 and overlap with the indication marking 141 of the indication area 14. However, the trademark (i.e., the indication marking 141) in the indication area 14 is larger than each character unit 131 to provide the desired characterizing effect.

Figure 8:
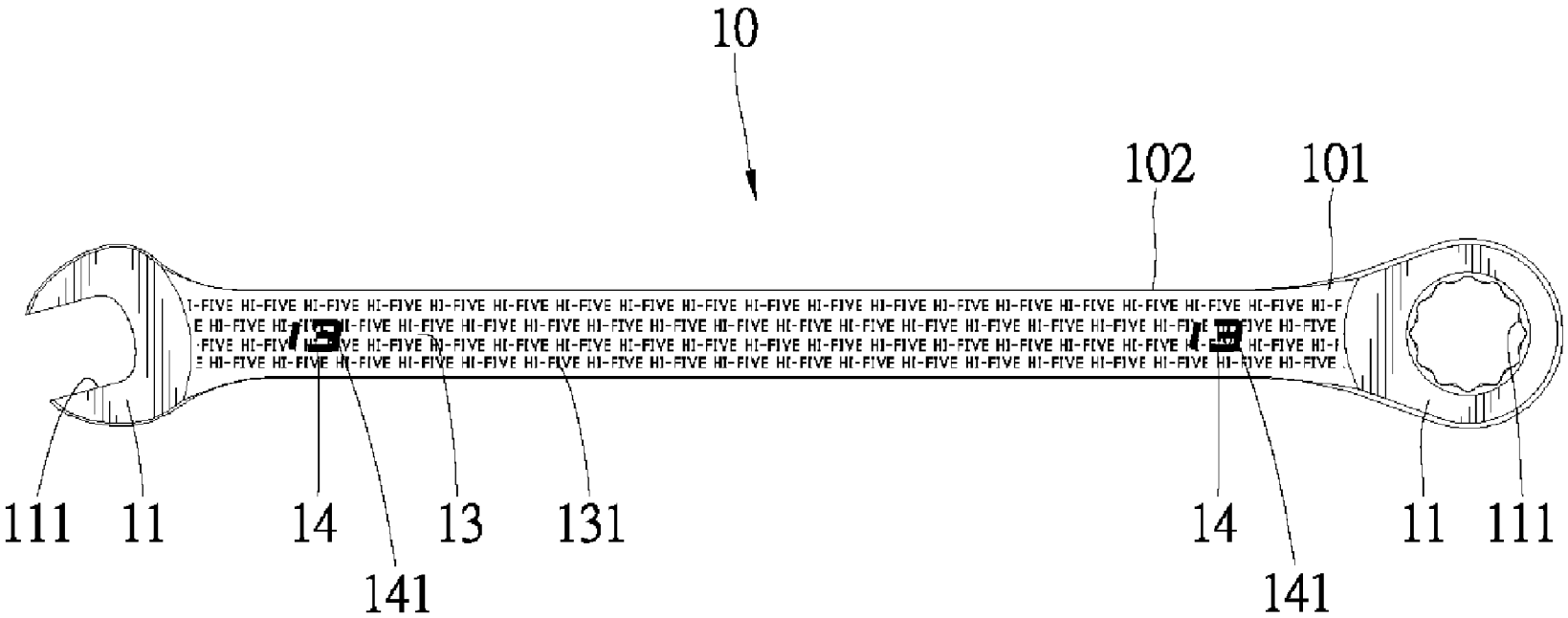
FIG. 8 is a top view illustrating still another example of the wrench in accordance with the present invention.

In the example shown in FIG. 8, there are two indication areas 14 on each holding face 101, with the indication marking 141 in each indication area 14 showing the size of the wrench.

Figure 9:
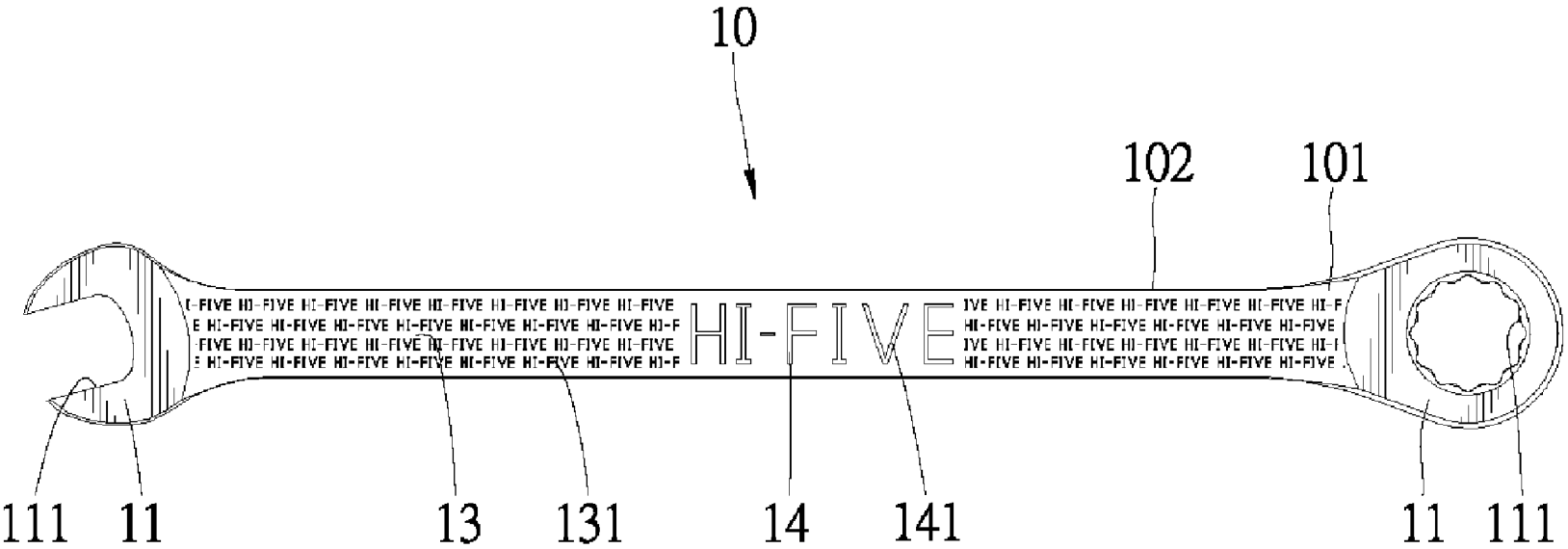
FIG. 9 is a top view illustrating yet another example of the wrench in accordance with the present invention.

In the example shown in FIG. 9, there is only one indication area 14 on each holding face 101, with the indication area 14 separating the anti-slipping section 13 into two parts, with left and right sides of the indication marking 141 in the indication area 14 being spaced from the parts of the anti-slipping section 13, and with upper and lower sides of the indication marking 141 in the indication area 14 being free of the character units 131.

In the examples of the present invention, the length of the indication marking 141 in the indication area 14 is preferably two to four times of that of each character unit 131 and the width of the indication marking 141 in the indication area 14 is preferably two to four times of that of each character unit 131 to provide the desired characterizing effect.

Although specific embodiments have been illustrated and described, numerous modifications and variations are still possible without departing from the essence of the invention. The scope of the invention is limited by the accompanying claims.

What is claimed is:

1. A wrench comprising a body including two ends and a handle between the ends of the body, at least one of the ends of the body being adapted for driving an object, the handle including two holding faces and two lateral faces extending between the holding faces, a plurality of character units being provided on each said holding face and forming an anti-slipping section, at least one of the holding faces including at least one indication area located in said anti-slipping section, said at least one indication area including an indication marking, wherein the indication marking is the same as but larger than each said character unit;

wherein each said character unit consists of letters of an alphabet.

2. The wrench as claimed in claim 1 wherein the character units are embossed or debossed.

3. The wrench as claimed in claim 1 wherein the character units are regularly arranged to provide an anti-slipping effect in a desired direction.

4. The wrench as claimed in claim 1 wherein the character units are irregularly arranged to provide an anti-slipping effect in all directions.

5. The wrench as claimed in claim 1 wherein the indication marking has a length two to four times of that of each said character unit and a width two to four times of that of each said character unit.

6. The wrench as claimed in claim 1 wherein said at least one indication area is surrounded by the character units.

7. The wrench as claimed in claim 6 wherein at least some of the character units overlap with each other.

8. The wrench as claimed in claim 1 wherein the indication area is devoid of the character units and the indication marking is spaced from the character units.

9. The wrench as claimed in claim 1 wherein the character units extend into said at least one indication area and overlap with the indication marking.

10. The wrench as claimed in claim 1 wherein the holding faces of the wrench respectively correspond to upper and lower horizontal faces of the ends of the wrench and the lateral faces of the wrench correspond to outer circumferential faces of the ends of the wrench.

11. The wrench as claimed in claim 1 wherein at least some of the character units overlap with each other.

12. The wrench as claimed in claim 1 wherein each said character unit consists of a trademark.

13. A wrench comprising a body including two ends and a handle between the ends of the body, at least one of the ends of the body being adapted for driving an object, the handle including two holding faces and two lateral faces extending between the holding faces, a plurality of character units being provided on each said holding face and forming an anti-slipping section, at least one of the holding faces including at least one indication area located in said anti-slipping section, said at least one indication area including an indication marking, wherein the indication marking is the same as but larger than each said character unit;

wherein each said character unit consists of numbers.

14. The wrench as claimed in claim 13 wherein the indication marking has a length two to four times of that of each said character unit and a width two to four times of that of each said character unit.

15. The wrench as claimed in claim 12 wherein the indication marking has a length two to four times of that of each said character unit and a width two to four times of that of each said character unit.

16. The wrench as claimed in claim 13 wherein the character units extend into said at least one indication area and overlap with the indication marking.

17. The wrench as claimed in claim 13 wherein the indication area is devoid of the character units and the indication marking is spaced from the character units.

18. The wrench as claimed in claim 13 wherein the character units are embossed or debossed.

19. The wrench as claimed in claim 13 wherein the character units are regularly arranged to provide an anti-slipping effect in a desired direction.

20. The wrench as claimed in claim 13 wherein the character units are irregularly arranged to provide an anti-slipping effect in all directions.

21. The wrench as claimed in claim 13 wherein said at least one indication area is surrounded by the character units.

22. The wrench as claimed in claim 21 wherein at least some of the character units overlap with each other.

23. The wrench as claimed in claim 13 wherein at least some of the character units overlap with each other.

24. The wrench as claimed in claim 13 wherein the holding faces of the wrench respectively correspond to upper and lower horizontal faces of the ends of the wrench and the lateral faces of the wrench correspond to outer circumferential faces of the ends of the wrench.

* * * * *